United States Patent [19]

Buzetzki

[11] Patent Number: 4,969,406

[45] Date of Patent: Nov. 13, 1990

[54] METHOD FOR THE THERMAL DECOMPOSITION OF A FLUID SUBSTANCE CONTAINED IN A GAS

[75] Inventor: Eduard Buzetzki, Wulkaprodersdorf, Austria

[73] Assignee: Franz Howorka, Vienna, Austria

[21] Appl. No.: 381,594

[22] Filed: Jul. 18, 1989

Related U.S. Application Data

[62] Division of Ser. No. 254,030, Oct. 6, 1988, Pat. No. 4,867,676.

[30] Foreign Application Priority Data

Apr. 22, 1988 [AT] Austria ..... 1032/88

[51] Int. Cl.[5] ..... F23B 7/00

[52] U.S. Cl. ..... 110/341; 110/346; 110/243; 110/244; 110/238

[58] Field of Search ..... 110/243, 244, 211, 214, 110/341, 346, 238

[56] References Cited

U.S. PATENT DOCUMENTS

| | | | |
|---|---|---|---|
| 3,885,507 | 5/1975 | Davy et al. | 110/243 |
| 4,023,508 | 5/1977 | Cantrell, Jr. et al. | 110/243 |
| 4,389,979 | 6/1983 | Saxlund | 110/244 |
| 4,475,472 | 10/1984 | Adrian et al. | 110/211 |
| 4,635,573 | 1/1987 | Santen | 110/244 |
| 4,779,545 | 10/1988 | Breen et al. | 110/214 |

*Primary Examiner*—Henry C. Yuen
*Attorney, Agent, or Firm*—Kurt Kelman

[57] ABSTRACT

A method for the thermal decomposition of a fluid toxic substance contained in a gas comprises a cylindrical main combustion chamber and a secondary combustion chamber arranged thereabove. An inlet opening leads into the main combustion chamber at an angle to introduce a stream of the gas containing the toxic substance into the main combustion chamber with an angular momentum, a burner is arranged to direct a flame into the main combustion chamber above the inlet opening for subjecting the gas containing the toxic substance to combustion, and an annular gas stream retaining device is arranged above the burner. This retaining device defines a central opening permitting the stream of gas to pass from the main combustion chamber into the secondary combustion chamber, the central opening having a diameter smaller than that of the cylindrical main combustion chamber, and passages arranged around the central opening, and the retaining device comprises obliquely downwardly directed nozzles for delivering secondary air into the main combustion chamber.

2 Claims, 3 Drawing Sheets

23
4a
III
20
10b
10a
12
4
13
3
4b
4b
III
1a
7
I
I
14b
10a
9
14a
3a
10b
9
13
8
6
4a
14b
11
4b
4
4a
2

5
8
6
11
7
1a
9
α
α
11
10b
14b
10a
14a
10a
1

METHOD FOR THE THERMAL DECOMPOSITION OF A FLUID SUBSTANCE CONTAINED IN A GAS

CROSS-REFERENCE TO RELATED APPLICATION

This is a division of my co-pending application Ser. No. 254,030, filed Oct. 6, 1988 now Pat. No. 4,867,676.

BACKGROUND OF THE INVENTION (1) Field of the Invention

The present invention relates to a method for the thermal decomposition of a fluid toxic substance, especially dioxins and furans, contained in a gas, such as a flue gas, in an apparatus which comprises a substantially cylindrical main combustion chamber, a secondary combustion chamber arranged thereabove, an inlet opening leading into the main combustion chamber preferably at an angle to a tangential plane for introducing a stream of the gas containing the toxic substance with an angular momentum into the main combustion chamber, and a burner arranged to direct a flame into the main combustion chamber for subjecting the gas containing the toxic substance to combustion. An annular gas stream retaining device is arranged above the burner, the retaining device defining a central opening permitting the stream of gas to pass from the main combustion chamber into the secondary combustion chamber, the central opening having a diameter smaller than that of the cylindrical main combustion chamber, and the retaining device comprises obliquely downwardly directed nozzle means.

(2) Description of the Prior Art

Certain highly toxic organic substances, such as dioxins and furans, can be economically disposed of only by thermally decomposing them into less problematic compounds at high temperatures. Published German Pat. application No. 2,357,804, for example, discloses a combustion apparatus comprising burners operated by fuels, such as natural gas or the like, for thermally decomposing such toxic substances. Combustion chambers of large volume are required to assure a dwell time of sufficient length to permit combustion of the substances in a high-temperature zone. Such furnaces are correspondingly expensive and, in addition, it is difficult to achieve a suitable mixing and turbulence of the gas stream in the combustion chamber to assure the desired thermal decomposition. If the volume of the combustion chamber is reduced, the dwell time of the toxic substances in the zone of high temperature is too short to permit the decomposition reactions to be fully completed.

SUMMARY OF THE INVENTION

It is the primary object of this invention to avoid these disadvantages and to provide a method for the thermal decomposition of a fluid toxic substance contained in a gas, which is compact and yet assures a sufficiently long dwell time of the toxic substance-containing gas in the combustion chamber to enable the thermal decomposition reactions to proceed to completion.

The above and other objects are accomplished by introducing a gas stream containing a toxic substance into a main combustion chamber, directing a flame from a burner into the main combustion chamber, retaining the gases in the main combustion chamber by a downwardly directed stream of secondary air emerging from inlets arranged in a gas stream retaining device arranged above the burner, and letting the flue gases pass through an opening in the retaining device into a secondary combustion chamber and further into a chimney.

The gas containing the toxic substance to be decomposed is introduced through the inlet opening or openings into a bottom portion of the main combustion chamber and serves as primary air for the operation of the burner or burners. The first phase of combustion is carried out stoichiometrically or slightly less than stoichiometrically. The high temperatures of 800° C. to 1400° C. generated by this combustion favor the thermal decomposition of complex organic molecules, such as dioxins and furans. The retaining device prevents too rapid a draft of the gas out of the main combustion chamber, and the downwardly directed nozzles in the retaining device deliver secondary air into the main combustion chamber. This has the primary purpose of keeping the combustion gases longer in the main combustion chamber. Furthermore, the delivery of the secondary air into the main combustion chamber produces a substantial excess of air therein, which assures a complete combustion of all combustible components and thereby achieves an extremely low hydrocarbon and CO emission. Extended tests have shown that it is advantageous to provide not only a central opening in the retaining device for the escape of the flue gases from the main combustion chamber in the direction of the chimney but to provide further passage means therefore surrounding the central opening in the range of the combustion chamber wall. Because of the angular momentum imparted to the stream of gas, the heavier components thereof tend to remain in the region of the combustion chamber wall while the lighter gas components tend to accumulate in the region of the combustion chamber axis. Providing the central opening as well as the surrounding passage means in the retaining device prevents an undesired selective removal of the light gas components. Preferably, the annular retaining device comprises webs between the central opening and the passage means, the webs having the shape of an annular sector and concentrically surrounding the axis of the cylindrical main combustion chamber. These webs are connected to an outer part of the annular retaining device by two or more holding webs. The resultant passages, which constitute the passage means, have the shape of annular sectors.

The thermal decomposition furnace may comprise a modularly assembled furnace wall comprising a plurality of superposed annular segments, the furnace wall defining a substantially cylindrical main combustion chamber and a secondary combustion chamber arranged thereabove. An annular gas stream retaining device is arranged between the combustion chambers, the retaining device defining a central opening having a diameter smaller than that of the cylindrical main combustion chamber, and one of the annular furnace wall segments forms an outer part of the retaining device.

Such a thermal decomposition furnace has a very simple structure. More particularly, prefabricated modules may be used in assembling the furnace so that the time for erecting the furnace on site may be considerably reduced. Proper sealing between the modular assembly components may be obtained by fitting them together by tongue-and-groove connections. A further advantage of such a structure resides in the fact that the same set of modules may be used to build combustion chambers of different sizes so that an ideally suited furnace may be built for each prevailing operating condition.

BRIEF DESCRIPTION OF THE DRAWING

The above and other objects, advantages and features of this invention will become more apparent from the following detailed description of a now preferred embodiment of an apparatus for carrying out the thermal decomposition, taken in conjunction with the accompanying drawing wherein.

DETAILED DESCRIPTION OF PREFERRED EMBODIMENT

Figure 1:
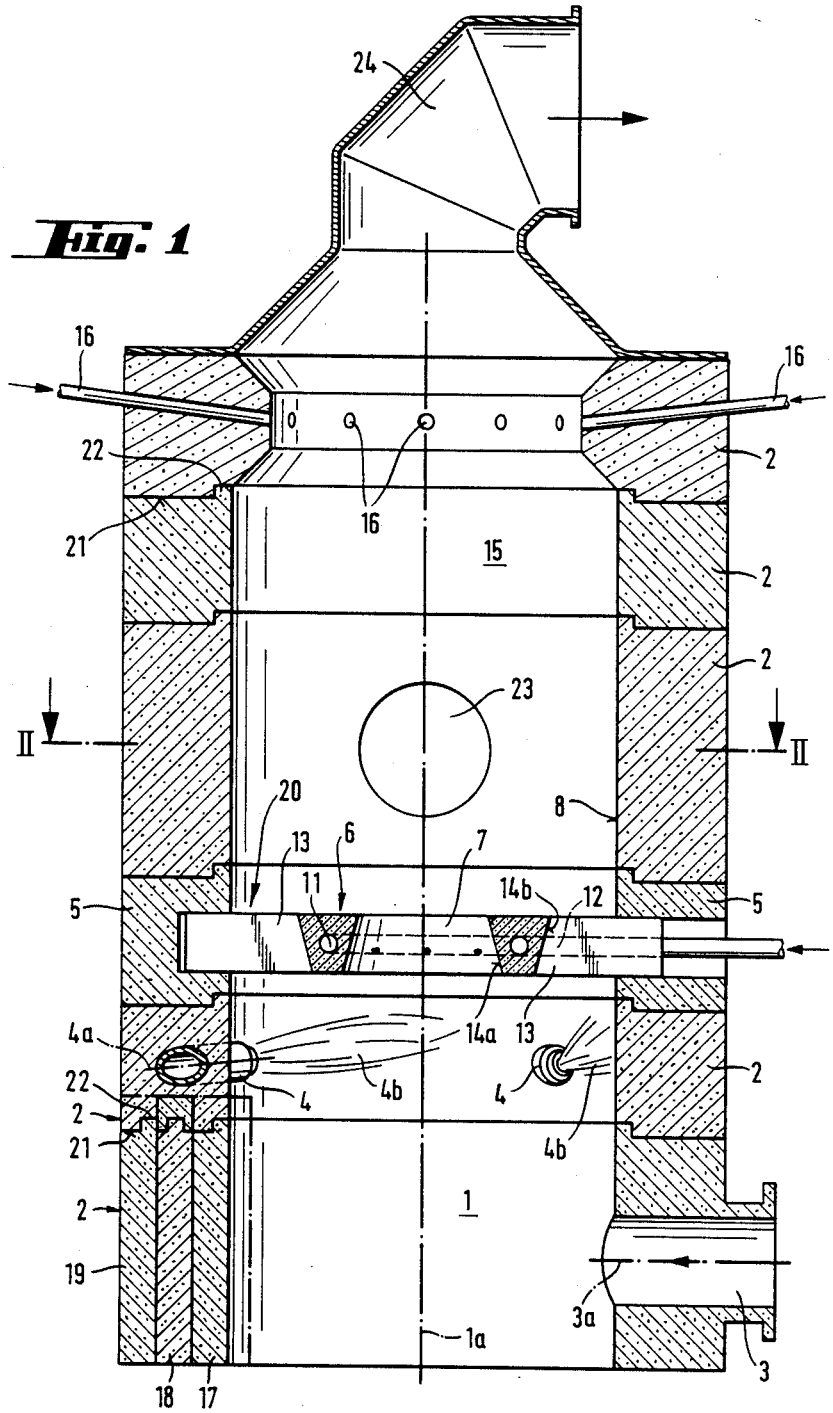
FIG. 1 is an axial section of a furnace according to the invention.

Referring now to the drawing illustrating an apparatus for the thermal decomposition of a fluid toxic substance contained in a gas, there is shown a furnace comprising substantially cylindrical main combustion chamber 1 defined by an outer wall part consisting of annular segments 2 forming the wall of the furnace. The furnace wall segments are substantially annular and are composed of a plurality of layers, FIG. 1 showing an inner layer 17 of refractory bricks and two layers 18, 19 surrounding the inner refractory brick layer and consisting of insulating bricks. The multi-layered construction of the furnace wall segments enables optimal materials to be used for the combustion chamber wall in all areas thereof. As is known, a rock wool insulation and a steel jacket may surround the furnace wall segments. A steel jacket can absorb the stresses resulting from the thermal extension of the bricks so that the resultant pressure imparted to the bricks provides a first seal for the combustion chamber. The steel jacket itself constitutes a further seal so that it is not necessary to operate the apparatus under a vacuum. This saves the use of an expensive suction ventilator.

As shown in FIG. 1, abutting end faces 21 of furnace wall segments 2 have annular ridges or tongues 22 defining annular grooves therebetween so that abutting segments are fitted together by tongue-and-groove connections assuring a proper seal between the segments. The furnace wall segments are alike and accordingly exchangeable so that they may be combined in any desired manner for building combustion chambers of the same diameter but of different volumes.

The illustrated apparatus further comprises secondary combustion chamber 15 arranged above cylindrical main combustion chamber 1 and inlet opening 3 leading into the main combustion chamber for introducing a stream of the gas containing the toxic substance into the main combustion chamber. The gas may be the flue gas coming, for example, from a garbage burning installation. Since such installations usually operate with an excess of air, the flue gas contains oxygen and may serve as combustion gas. If no oxygen or not sufficient oxygen is present in the gas stream introduced into main combustion chamber 1, it may be mixed with the ambient air. While axis 3*a* of inlet opening 3 may be directed against axis 1*a* of the main combustion chamber, i.e. may extend radially, it is preferred to direct the inlet opening into main combustion chamber 1 at an acute angle to a tangential plane to impart an angular momentum to the stream of gas introduced into the main combustion chamber. This angular momentum causes a turbulence in the gas stream which assures a good mixing of the gas components in the main combustion chamber and thus optimizes the efficiency of the operation.

In the illustrated embodiment, three schematically shown burners 4 are arranged to direct flame 4*b* into main combustion chamber 1 above inlet opening or openings 3 for subjecting the toxic substance to combustion. The three burners are uniformly spaced about the periphery of the main combustion chamber but it will be understood that a single burner or more than three burners may be used. Axes 4*a* of the burners are slightly upwardly directed and also extend at an acute angle to a tangential plane to reinforce the angular momentum imparted to the gas stream. The arrangement of the burner above the inlet opening assures that the entire stream of gas will flow through flame 4*b* and that all the gas will thus be subjected to combustion.

Figure 3:
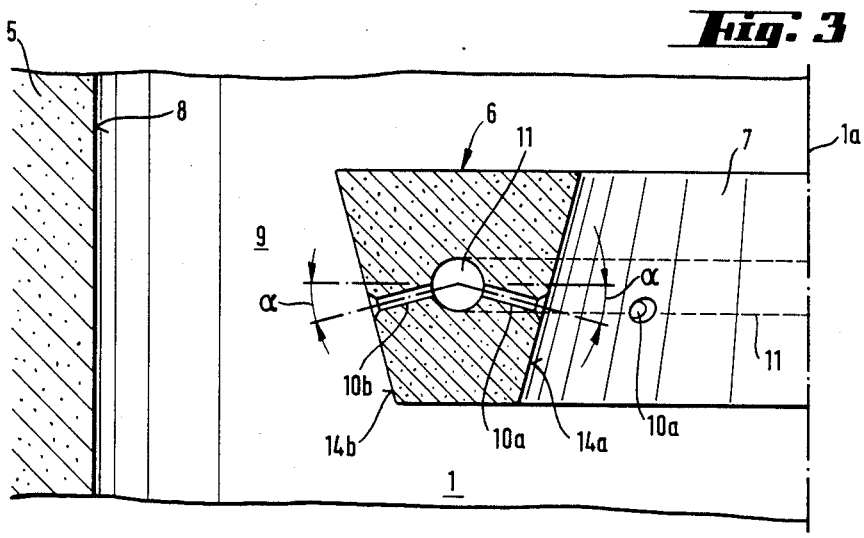
FIG. 3 shows an enlarged view of one detail of a web of the retaining device.
Figure 4:
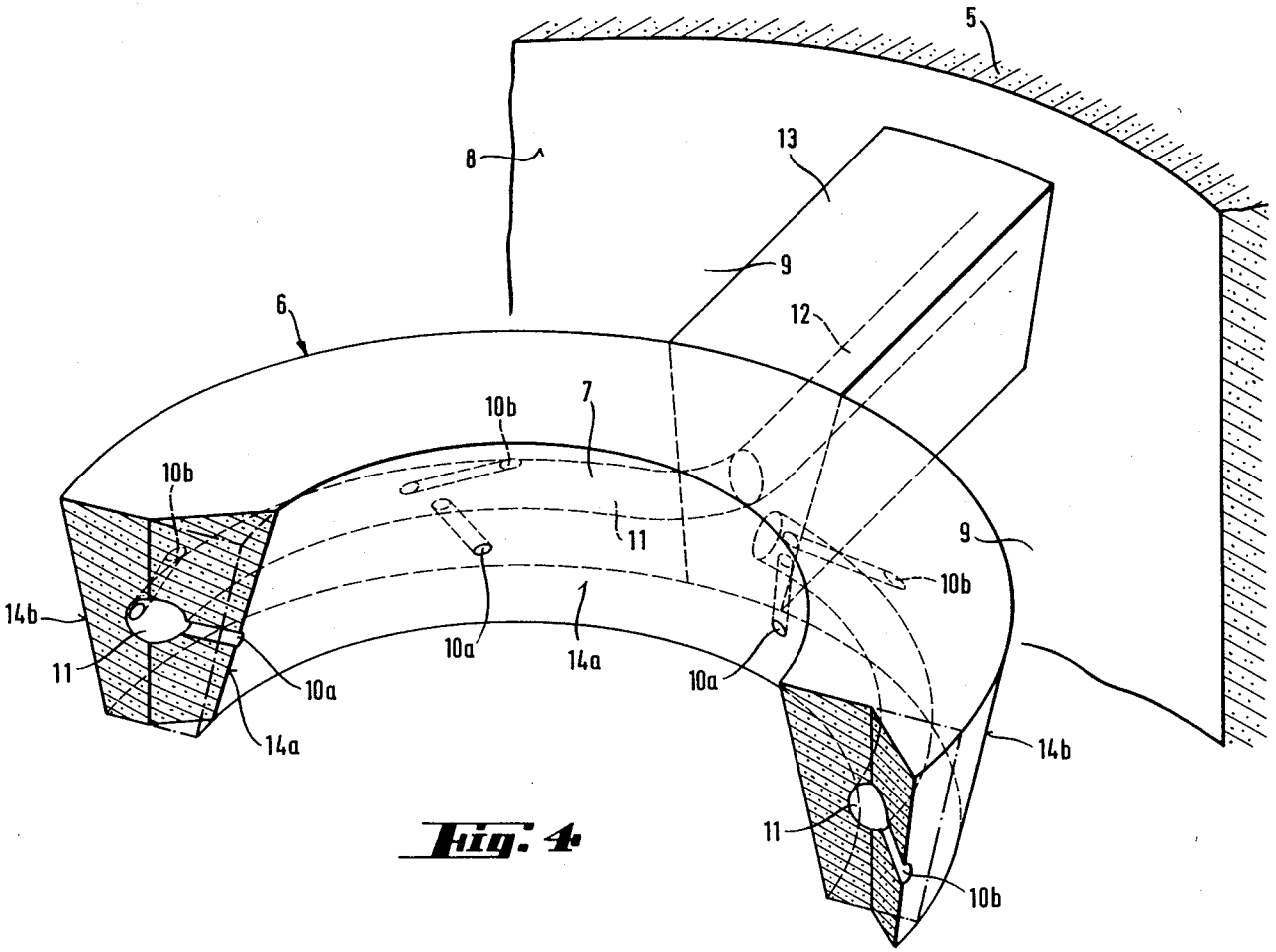
FIG. 4 is another enlarged view showing another detail of the web.

As shown in FIG. 1, annular gas stream retaining device 20 is arranged above burners 4 between main combustion chamber 1 and secondary combustion chamber 15, separating the two chambers from each other. The retaining device defines central opening 7 having a diameter smaller than that of cylindrical main combustion chamber 1 and permitting the stream of gas to pass from the main into the secondary combustion chamber, and passage means consisting of passages 9 arranged around central opening 7. In the illustrated furnace, annular furnace wall segment 5 forms an outer part of the retaining device and its inner part is comprised of webs 6 each having the shape of an arcuate sector and fitted together to form an annular retaining device body with central opening 7. Webs 6 between central opening 7 and surrounding passages 9 have a substantially trapezoidal cross section (see FIG. 3) with downwardly converging side faces. This shape provides the best housing for secondary air nozzles 10*a*, 10*b* because it prevents the angle between the downwardly directed nozzles and the side faces of the webs from being too flat. Passage means is arranged in the retaining device around the central opening and is defined in the illustrated embodiment by passages 9 between webs 6 and inner wall 8 of the combustion chambers.

Retaining device 20 further comprises obliquely downwardly directed nozzle means 10*a*, 10*b* for delivering secondary air into main combustion chamber 1 at an angle $\alpha$ of preferably 15°. In the illustrated embodiment (see FIG. 3), nozzles 10*a* are tangentially inwardly directed while nozzles 10*b* are tangentially outwardly directed to enhance the angular momentum of the secondary air delivered therethrough into the main combustion chamber, the nozzles being oriented substantially in the angular direction of the gas stream in the main combustion chamber. The nozzles are not directed towards combustion chamber axis 1*a* but away from it. This will produce not only an optimal dwell time for the combustion gases in the combustion chamber but also will produce a desirable downwardly directed turbulence of the gas churning in the chamber. By directing the delivery of the secondary air obliquely downwardly, a rapid flow of the gas stream towards the chimney will be prevented. Outwardly directed secondary air delivery nozzles 10*b*, which extend substantially tangentially with respect to a center circle inscribed in web 6, delay the flow of the gases through passages 9 while similarly extending, inwardly directed nozzles 10*a* delay the gas flow through central opening 7. All the nozzles have the same orientation with respect to axis la of the combustion chambers as burners 4, either in a clockwise or counter-clockwise direction. This further enhances the angular momentum of the gas flow in the combustion chamber, thus increasing the mixing effect and corresponding improving the combustion.

Figure 2:
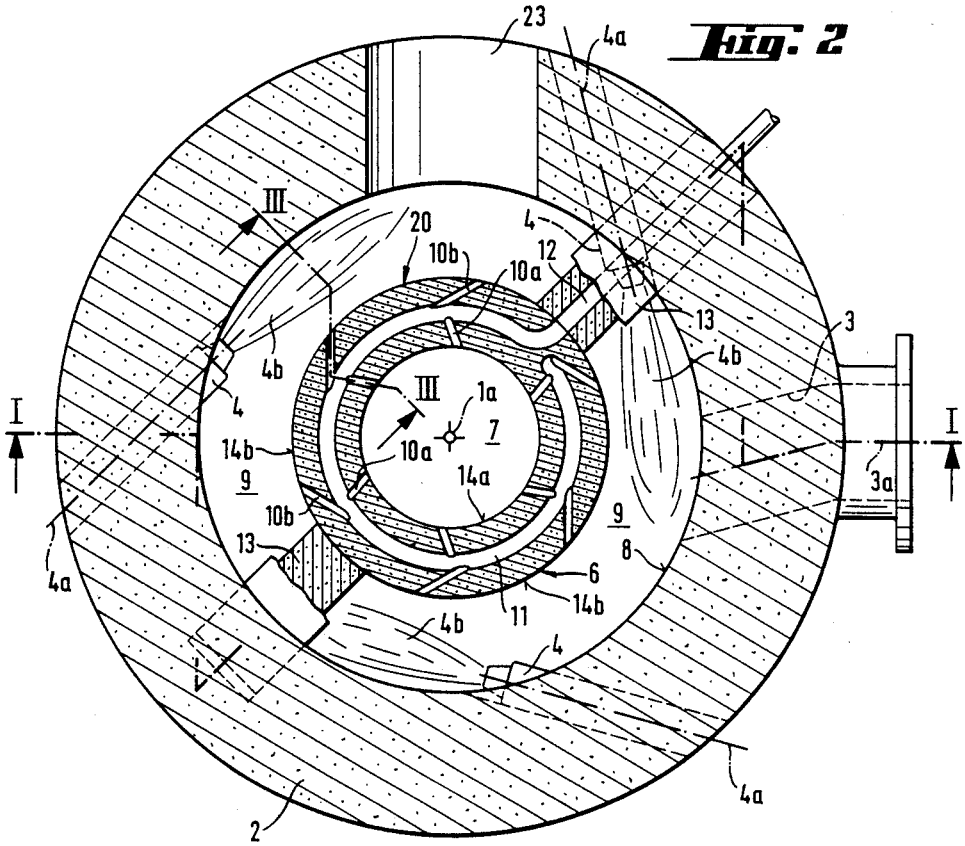
FIG. 2 is a horizontal section along line II—II of FIG. 1.

Annular retaining device 20 further comprises holding webs 13 for webs 6 (see FIG. 2). Holding webs 13 separate passages 9 from each other and arcuate-shaped webs 6 define channels 11 for the secondary air in the interior thereof between central opening 7 and surrounding passages 9. Holding webs 13 define channels 12 for delivering the secondary air to channels 11 in webs 6. In this way, the secondary air delivery nozzles may be distributed along the entire periphery of the webs.

If desired, the secondary air may contain a further environmentally problematic substance, either in liquid form or in the form of solid particles. This considerably enlarges the field of usefulness of the apparatus. This may be particularly advantageous when gases which contain a higher concentration of toxic substances than flue gases, for example, are detoxified. It is then possible to deliver ash with the secondary air into the main combustion chamber, which is then removed as an inert vitrified medium from the bottom of the combustion chamber after it has passed therethrough. The vitrified ash may be disposed without problems since it contains no water-soluble substances. In this way, the apparatus may be used to treat not only the flue gases but also the ashes.

It is advantageous to design annular retaining device 20 so that it reduces the cross section of the gas stream passing therethrough by 20% to 50%, preferably 30% to 35%. In other words, as seen in a top plan view, the webs of retaining device 20 cover this preferred percentage of its area. The cross section of the gas stream is limited to central opening 7 and surrounding passages 9. In the design of retaining device 20, it is important to consider the advantage of the longest possible dwell time of the gas stream containing the toxic substance in the main combustion chamber, which means, among other factors, that the retaining device must provide as large a hindrance as possible to the flow of the gas stream. On the other hand, the pressure loss in the main combustion chamber should be held to a minimum so that the gas stream will leave it preferably under its own draft force or, at least, with as small a ventilation installation as possible. Tests have shown that these conditions are best met with the above-indicated percentage ranges, a reduction of the cross section of the gas stream by about a third being most advantageous.

Secondary combustion chamber 15 is arranged in the furnace above gas stream retaining device 20 to complete the combustion process. Tertiary gas delivering nozzles 16 are arranged at an upper end of the secondary combustion chamber (see FIG. 1) to increase the excess of available combustion air and to cool the gas escaping through the chimney (not shown) which is mounted on the furnace by elbow 24 which deflects the gas flow. Nozzles 16 are also slightly downwardly directed into secondary combustion chamber 15 to increase the dwell time of the gas in this combustion chamber, too. Cooling of the gas and combustion thereof with an added supply of tertiary air will further enhance the purification of the flue gas leaving the furnace.

As shown in FIG. 1, man hole 23 is provided in the wall of secondary combustion chamber 15. While a suction fan is usually not needed to cause the required draft for moving the gas stream from inlet opening 3 to the chimney, it may be provided if so desired. In operation, the gas containing a toxic substance and coming, for example, from a garbage combustion plant is directed through inlet opening 3 into main combustion chamber 1 where it flows spirally upwardly and passes through the flames generated by burners 4. The secondary air flowing downwardly through nozzles 10*a*, 10*b* in gas stream retaining device 20 brakes the upward flow of the gas and thus increases its dwell time in the main combustion chamber. Finally, the gas flows through central opening 7 and passages 9 into secondary combustion chamber 15 where the thermal decomposition of the toxic substances is completed. The purified gas then leaves the apparatus through elbow 24 and the chimney attached thereto.

An apparatus of the above-described structure will produce an almost complete removal of all toxic substances from the treated gas under all practical operating conditions, including conditions in which it is only partially charged, and this is accomplished with a furnace of relatively simple structure and which may be constructed at low cost.

I claim:

1. Method for the thermal decomposition of a fluid toxic substance contained in a gas which comprises the following steps:

(a) introducing a stream of the gas containing the toxic substance into a main combustion chamber, (b) directing a flame from a burner into said combustion chamber, (c) providing a source of secondary air and mixing said secondary air with another toxic substance before directing it into the combustion chamber, (d) retaining the toxic substance containing gas stream in the main combustion chamber by a downwardly directed stream of said secondary air emerging from inlets arranged in a gas stream retaining device arranged above the burner until the toxic substance in the gas stream has been thermally decomposed to produce flue gases substantially free of the toxic substance, and (e) letting the flue gases pass through an opening in said retaining device into a secondary combustion chamber and further into a chimney.

2. Method of claim 1, wherein the flue gases pass through a central opening in said retaining device as well as through further openings surrounding the central opening in the range of the wall of said combustion chamber into said secondary combustion chamber and further into said chimney.

* * * * *